US005709636A

United States Patent [19]

Vallone et al.

[11] Patent Number: 5,709,636

[45] Date of Patent: Jan. 20, 1998

[54] PORTABLE EXERCISE DEVICE

[76] Inventors: Anthony J. Vallone, 1747 Beechwood Ave. NE. #9, North Canton, Ohio 44720; John F. Vallone, Sr., 63 Crestmont Rd., Binghamton, N.Y. 13905

[21] Appl. No.: 421,741

[22] Filed: May 24, 1995

[51] Int. Cl.[6] ..... A63B 21/04

[52] U.S. Cl. ..... 482/129; 482/904; 482/136

[58] Field of Search ..... 482/114, 116, 482/121, 904, 120, 115, 136, 92, 135, 908, 909, 148, 51, 129

[56] References Cited

U.S. PATENT DOCUMENTS

| | | | |
|---|---|---|---|
| 0,655,671 | 8/1900 | Crooker et al. | 482/121 |
| 4,685,670 | 8/1987 | Zinkin | 482/904 |
| 4,848,741 | 7/1989 | Hermanson | 482/121 |
| 4,896,881 | 1/1990 | Djerdjerian | 482/904 |
| 4,944,511 | 7/1990 | Francis | 482/116 |
| 5,303,716 | 4/1994 | Mason et al. | 482/904 |
| 5,468,205 | 11/1995 | McFall et al. | 482/904 |

*Primary Examiner*—Stephen R. Crow

[57] ABSTRACT

A portable exercise device for use by individuals without supervision to follow prescribed or desired therapeutic exercise regimens is provided. The portable exercise device preferably includes two pulley assemblies, mounted and secured to individual 'O' clamp assemblies, interconnected by a flexible cord, with bayonet clips secured at both ends of the cord, and supplemented with hand grip, precision straight scale and a dual purpose knee flex and anchoring harness. The 'O' clamp screw and pressure plate assembly may be disassembled and employed in either of two clamp screw holes. One pulley assembly is preferably configured with one grooved roller and functions as a pilot pulley. The second pulley assembly is configured with two grooved rollers and includes a cord locking mechanism to permit cord travel in one direction while resisting travel in the opposite direction. The portable, exercise device accessories include a hand grip and precision, spring type, straight scale to permit exerting and measuring forces applied for individual therapeutic regimens.

9 Claims, 4 Drawing Sheets

1
2
3
4
5
6
7
8
9
10
11
12
13
14
15
16
17
18
19
20
21

PORTABLE EXERCISE DEVICE

BACKGROUND OF THE INVENTION

1. Field of the Invention

The present invention relates to an orthopedic device for rehabilitation of orthopedic joints which have experienced loss of flexibility and/or range of motion due to surgery or injury. More specifically, the present invention relates to an orthopedic device which allows prescribed physical therapy regimens to be safely applied and controlled both by the patient (user) at home or by qualified physical therapists and technicians in the treatment facility.

2. Prior Art

Injuries to, and surgical procedures on, arm and leg joints require prescribed physical therapy regimens to restore flexibility and range of motion to the afflicted joint(s). In the past, and currently, the prescribed physical therapy regimens have been applied using weights, other low and high tech isokinetic muscle developer/toner devices, and exercises to restore the required degree of flexibility and range of motion to the affected joint.

Currently, no device is known, which may be used conveniently at home or at a designated treatment facility by either the patient, the technician or the physical therapist for applying therapeutic isotonic stresses to knee, hip, shoulder, elbow and wrist joints.

OBJECTS AND SUMMARY OF THE INVENTION

The principal objectives of this invention is to provide a device for applying isokinetic regimens to obtain flexibility, range of motion and muscular integrity to joints.

It is also the object of this invention to provide a device that permits economical construction and portability for achieving desired exercise regimens.

Briefly, a portable othropedic, therapeutic, isometric exercise device that is constructed and arranged according to the present invention has two (2) pulley assemblies, each with a suitable detachable connection for supporting each in a predetermined location. A flexible cord is threaded through each assembly guided by grooved rollers, and the cord passes also an arrangement to limit or prohibit movement in one direction while permitting ready movement in the opposite direction.

These and other objects, features and advantages of the invention will become more readily apparent from the following detailed description of this presently preferred embodiment when taken in conjunction with the accompanying drawings.

DETAILED DESCRIPTION

Figures 1, 2:
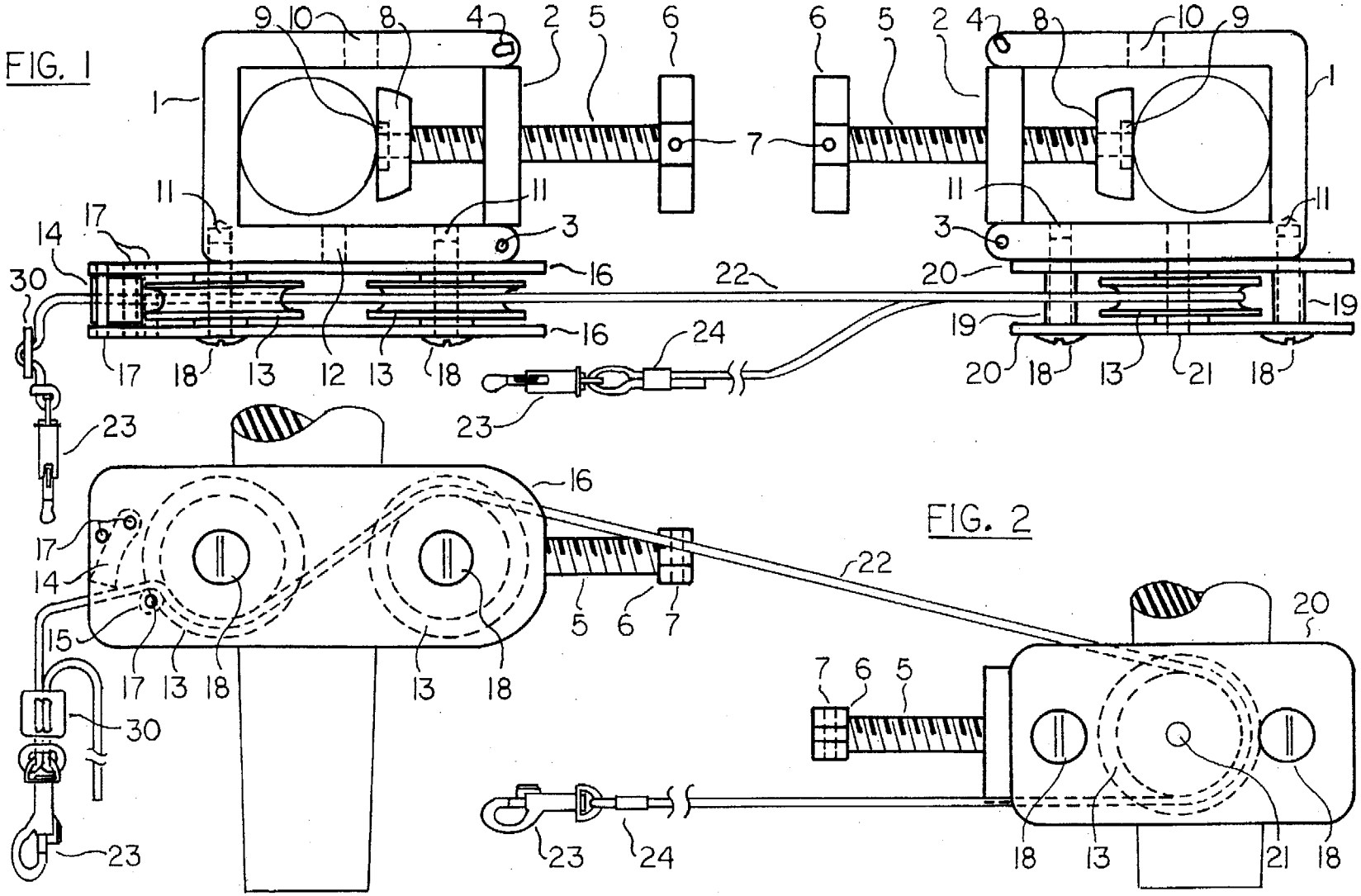
FIG. 1 is a top view of the portable exercise device.
FIG. 2 is a side view projection of FIG. 1.
Figures 3, 4, 5, 6, 7, 8:
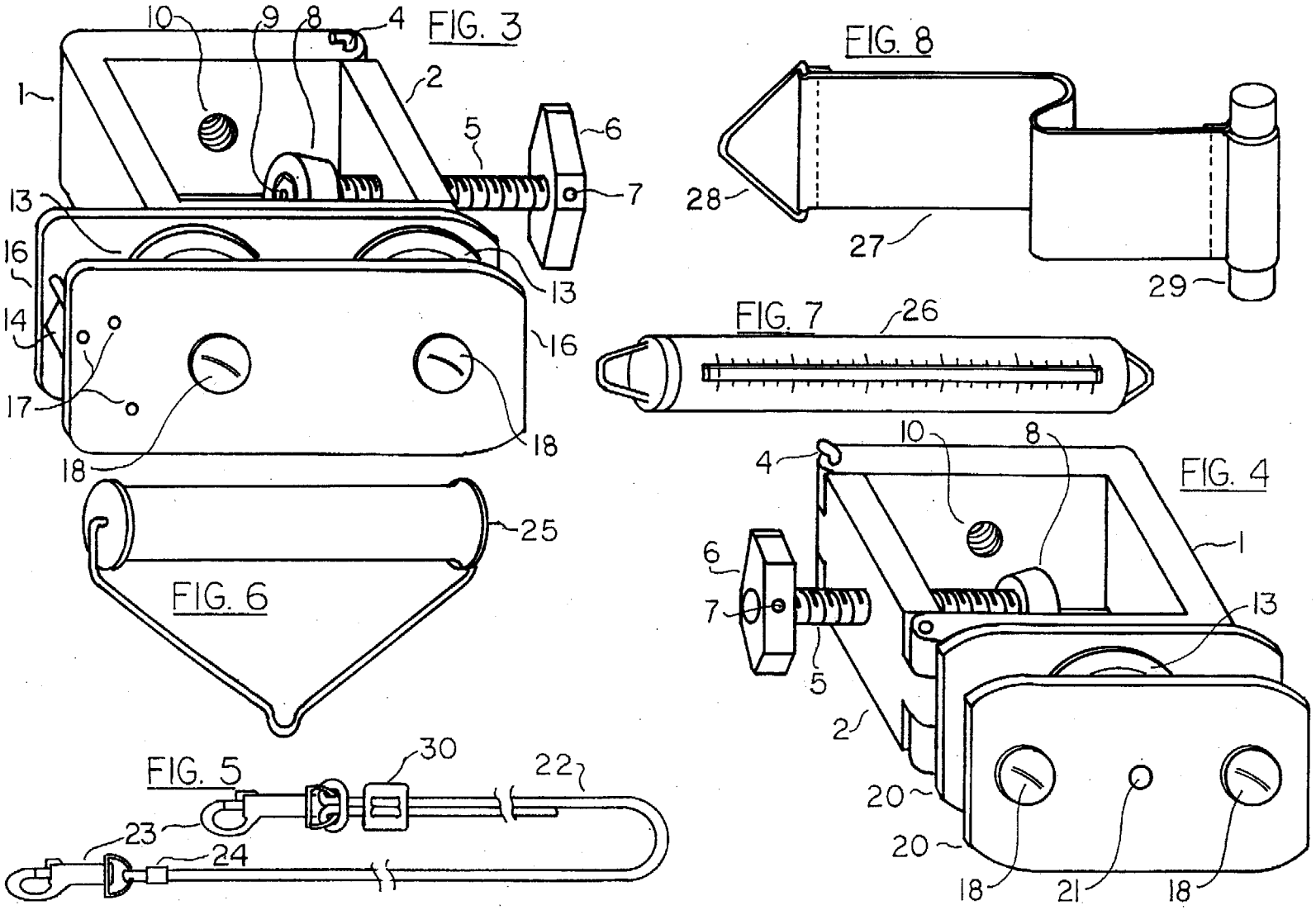
FIGS. 3 and FIG. 4 present frontal isometric views of the single roller pilot pulley assembly and the dual roller pulley with integral locking mechanism, respectively.
FIG. 5 depicts the device pulley cord with the fixed bayonet Flip on one end and the slip knot secured bayonet clip on the other.
FIG. 6 depicts a hand grip which is used as an accessory item to the invention.
FIG. 7 depicts a precision straight scale which is used as an accessory item to the invention.
FIG. 8 depicts the dual purpose knee flex harness and door anchor as an integral accessory to the invention. device.
Figures 9, 10, 11:
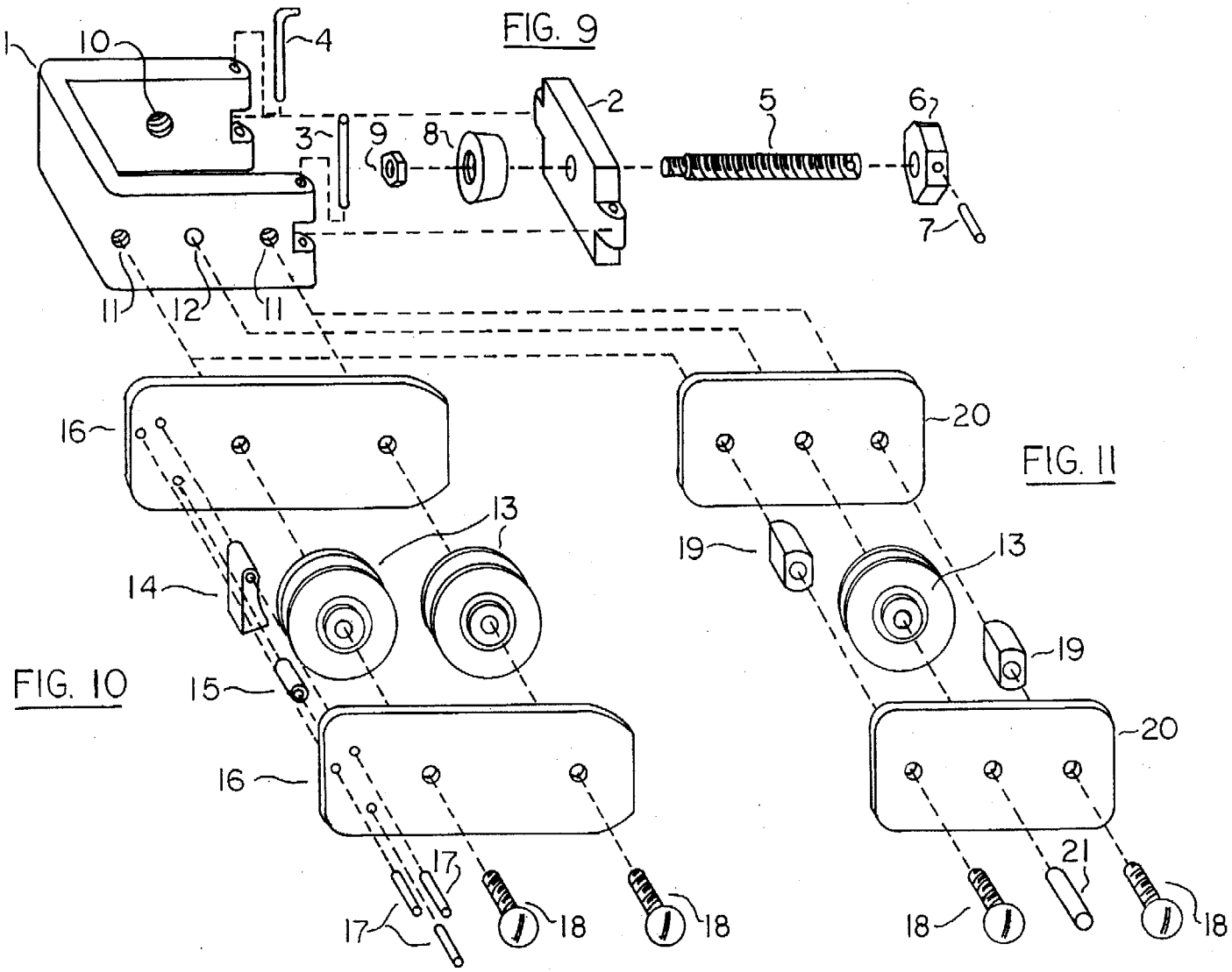
FIG. 9 depicts an exploded views of the clamping device assembly.
FIG. 10 depicts an exploded view of the dual roller pulley assembly with integral locking device.
FIG. 11 depicts an exploded view of the Pilot (single roller) pulley assembly.

As depicted in the drawings (FIGS. 1 through 11), the preferred embodiment of the portable exercise device in accordance with the invention includes two identical 'O' Clamp assemblies 1. The 'O' clamp main frame is shaped as a 'U' and the open end is dadoed to host a pinioned hatch 2 which is secured to the main frame by a fixed dowel 3 and a removable dowel 4. A threaded hole is centered vertically and horizontally on the hatch to host the clamp screw 5 which consists of a handle 6 secured to the screw by dowel 7 are mounted in the hatch so as to be external to the 'O' clamp enclosure. The screw pressure plate 8 is secured to the screw by hexnut 9 so as to be internal to the 'O' clamp enclosure.

The 'O' clamp main frame also contains threaded hole 10 to accommodate screw assembly 5–9 for better grips on wide narrow furniture or work bench legs/spindles. Two threaded holes 11 and pilot port 12 are provided to host either pulley assembly wherein the dual roller pulley assembly requires only two screw holes and the pilot pulley (single roller) assembly requires two screw holes and a pilot port to accommodate the roller axle.

The standard 'O' clamp size is 2.5 inches wide, 3.5 inches in length and 1.5 inches in height (6.35 cm.×8.88 cm×3.81 cm). The clamp, which may be constructed of ⅜ inch polycarbonate plastics, or ¼ inch aluminum (or other high strength non-ferrous metals) for the preferred embodiment of the invention. Cold rolled steel, high carbon steel, tool steel or other high strength ferrous materials may be used to satisfy other applications of the 'O' clamp assembly.

The 'O' clamp has an operational width of 1.75 inches, length of 2.25 inches (4.44 cm×5.72 cm). This configuration is compatible with the legs of most furniture or possible exercise platforms, tables or benches.

Out sized 'O' clamps compatible with both thin legged or wide legged furniture or exercise platforms/benches will be provided as alternate configurations. The constraint on dimensions is based on the pulley assembly mounting bolts centerline distance of 2.5 inches (6.35 cm). Therefore the minimum length of the 'O' clamp is 2.125 inches (5.39 cm).

Additionally, the 'O' clamp, as a stand—alone item with or without mounting screw holes and pilot port, has wide application for hobbyists, modelers, workshops and light industrial uses.

The dual roller pulley assembly with integral locking mechanism construction is comprised of dual rollers 13, a locking trigger 14, and a locking anvil sleeve 15. These components are sandwiched between two (2) pulley assembly side panels 16. The locking trigger 14 and the locking anvil sleeve 15 are secured to the side panels with dowels 17. A third dowel 17 is employed as a backstop to restrict rotational travel of the locking trigger. The pulley assembly with dual rollers are mounted and secured to the 'O' clamp assembly with two modified carriage bolts 18 (shoulders removed and screw driver slot cut into the bolt head).

The dual roller pulley assembly may be mounted to the 'O' clamp with the locking mechanism facing away from the hatch end of the clamp to restrict the pulley cord (22) from feeding back through the pulley assembly when back pressures are applied. Alternatively, the pulley assembly may be mounted to the 'O' clamp assembly with the trigger mechanism facing the 'O' clamp hatch to provide maximum resistance (restrict forward feed of the cord) for those exercise regimens which require pulling against measured resistive forces.

The dual roller configuration measures 0.75 inches in width, 4.0 inches in length and 2.0 inches in height (1.91 cm×10.16 cm×5.08 cm) and is constructed of 0.125 inch thick polycarbonate plastic or aluminum. The off-the-shelf rollers are preferably nylon with a steel core with roller or ball bearing hubs. The rollers typically measure 1.6875 inches in diameter (4.29 cm).

The pilot pulley assembly construction is comprised of a single roller 15 and two (2) spacers 19 sandwiched between two (2) pulley side panels 20. The pulley assembly is mounted and secured to the 'O' clamp assembly with two (2) modified carriage bolts 18. The singular roller is mated to the pulley and 'O' clamp assembly with a dowel 21 which functions as the roller axle and alines the roller with pilot port 12 in the 'O' clamp assembly.

Preferably, the 'O' clamp assembly and all components of the pulley assemblies, excluding the carriage bolts, rollers and locking anchor sleeve, may be constructed of polycarbonate plastics. Alternatively, these assemblies and components may be constructed of aluminum or other light weight high strength metals or materials.

Nylon rollers with steel core and ball or roller bearing hubs are the preferred off-the-shelf rollers for the pulley assembly although brass, aluminum, phenolic or other composite materials products may be used.

The pulley cord 22 and bayonet clips 25 are standard off-the-shelf items. The cord crimper 24, constructed of aluminum or other soft metal, is designed to crimp the cord end to form a fixed loop to secure one (1) bayonet clip. The cord is threaded through the cord lock 30, forming a loop which forms the slip knot for the other bayonet clip. The slip knot allows adjustments to the operational length of the cord for individual therapy regimens.

The slip knot end of the pulley cord is threaded counter clock-wise around the pilot pulley roller. It is then threaded counter clockwise around the rear roller and clockwise around the front roller of the dual roller pulley assembly. The cord is then threaded through the aperture between the locking trigger and the locking anvil for both locking mechanism positional profiles.

Hand grip 25 and the precision straight scale 26 are standard off the shelf items. The graphics representations of these items is used to depict generic models while actual shapes and forms may vary based on vendor designs. These accessories are secured to the bayonet clip at the slip knot end of the pulley cord as required for individual therapy regimens.

The dual purpose knee flex harness and anchor device construction is comprised of a web belt 27 looped at both ends to accommodate a Delta ring 28 and locking dowel 29. When used as a door anchor, the locking dowel is secured between the door jamb and a closed door. When used as a knee flex harness or as an anchor on the legs of the exercise platform, the dowel end of the harness is fed through the delta ring and the fixed bayonet clip on the pulley is secured to the harness Delta ring.

The overall construction and configuration of the portable exercise device device provides an effective, economical and fully transportable therapeutic device which offers simplicity of operation. The simplicity of operation concept allows the patient to perform prescribed therapy regimens independently, thereby reducing requirements for therapists hands on full time supervision and resulting in less expensive costs of therapy sessions. The adaptability of the device to multi-environmental scenarios negates the requirement for regularly scheduled visits to therapy facilities since the prescribed regimens may be conducted at home, in the office and occupational environments.

The aesthetics of the device are such that when attached to furniture, benches, platforms, etc., the device does not attract attention. The operational configuration, as depicted in FIGS. 1 and 2, ensures that the device does not protrude beyond the edge of the furniture/platform thereby negating individuals from knocking against the device, dislodging it or causing personal injury—an added personal safety feature.

The preferred assemblage of the invention, the basic linear pulley assembly, with integral locking device, is formed by two separate pulley assemblies. Each assembly is mated to a clamping device to allow securing the pulleys to chair, table, desk and/or bedstead legs or other objects which host vertical or horizontal spindles or posts.

The rear (pilot) pulley assembly is comprised of a singular roller (ball or roller bearing core) while the front pulley is comprised of dual rollers (ball or roller bearing core) with an integral cord locking device to secure the cord from back sliding through the assembly when the desired level of tension is achieved. The dual roller assembly may be secured to the clamp assembly with the locking mechanism either facing forward to prevent back slippage or facing rearward to prevent forward feed through.

The securing clamps are constructed to accommodate either pulley assembly. Each clamp is comprised of the main frame, a pinioned hatch, and a turn screw. The turn screw may be applied either through the pinioned hatch or through the main frame body opposite site from the attached pulley assembly to accommodate a variety of clamping posts profiles.

The pulley cord is threaded through the pilot pulley assembly to the dual roller pulley assembly and through the aperture between the locking trigger and the locking guide bar. The cord is configured with a fixed bayonet clip on the pilot pulley end and a bayonet clip secured by a slip knot at the opposite end to allow adjustment of cord length to accommodate varied therapy sites and regimens.

Accessories include, but are not necessarily limited to:

a. A dual purpose harness for knee and hip flex exercises and alternatively as an anchor when needed to provide maximum resistance to perform wrist, arm, elbow, and shoulder therapy regimens. This harness is attached to the fixed bayonet clip end of the cord.

b. A hand grip attached to the bayonet clip secured by the slip knot. This grip is used to apply measured amount of tension for knee flex exercises and for wrist, arm, elbow, shoulder therapy regimens.

c. A precision straight spring scale (with last highest reading index marker) to measure and control applied forces/tension during therapy sessions. The scale may be attached between the fixed bayonet clip and the door anchor or between the slip knot bayonet clip and the hand grip, depending on the specified therapy regime.

Figure 12:
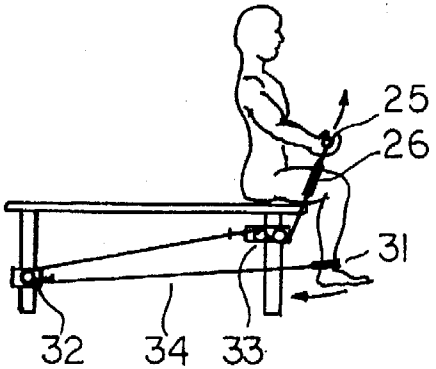
FIG. 12 provides a representation of the portable exercise device for knee, calf and thigh exercise regimens.

Application of this invention to the Physical Therapy regimes include, but are not limited to the following examples:

a. Knee Flex therapy: Refer to FIG. 12:

The knee/hip flex harness 31 is looped around the tibia, just above the ankle and secured to the fixed bayonet clip.

The pilot (singular roller) pulley assembly 32 is attached to the rear leg of a seating platform (stool, chair, desk or chair) at approximately the same level as the harness.

The dual roller pulley assembly 33 is attached to the front leg of the seating platform with the locking mechanism facing forward.

The pulley cord 34 is threaded through the assemblies to provide counter clockwise rotation of the pilot pulley and the rear pulley in the dual pulley assembly—and clockwise rotation of the forward roller in the dual roller pulley assembly.

The precision straight spring scale 26 is secured to the bayonet clip at the slip knot and the hand grip 25 is secured to the opposite end of the scale.

The seated patient, either through the assistance and/or guidance of the physical therapist, or following a prescribed routine, pulls on the hand grip pulling the lower leg backwards, thereby flexing the knee, until the prescribed level of tension is reached on the precision straight spring scale.

Figure 13:
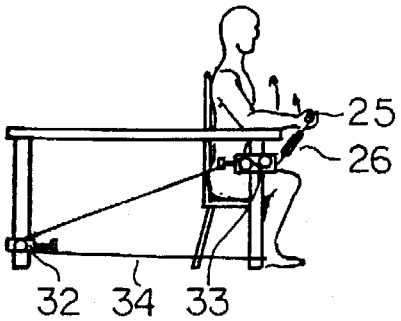
FIG. 13 provides a representation of the portable exercise device for wrist, forearm and elbow exercise regimens.

The patient (or therapist) then slackens the pull on the cord, the cord then starts to feed back through the pulley assembly, engages the locking mechanism and locks in place at the set level of tension. Repetitive pulls on the cord result in cumulative stresses on the affected limb due to the function of the locking mechanism in restricting cord feedback.

b. Wrist and/or Elbow Flex: Refer to FIG. 13.

The dual purpose knee/hip flex harness 31 is secured to the fixed bayonet clip and employed as an anchor—either secured to a door jamb or looped around the leg of an exercise platform (table, desk, work bench, etc.) farthest away (opposite) from the seated patient.

The pilot (single roller) pulley assembly 32 is secured the near leg (adjacent to the patient) of the exercise platform at approximately two (2) inches above floor level.

The dual roller pulley assembly 33 is secured to the far leg of the exercise platform (adjacent to the patient), with the locking mechanism facing away from the patient.

The pulley cord 34 is threaded through the pulley assemblies with the precision straight scale 26 and hand grip 25 secured to the bayonet clip at the slip knot end of the cord in the same manner as described above for the knee flex profile.

The seated patient, places his/her forearm flat on the exercise platform, grips the hand grip and extends the wrist in an upward direction—noting the tension deflection on the scale—and adjusting the slip knot to achieve the prescribed level of tension for the therapy regime. This adjustment is not necessary for elbow therapy regimens since the rotation of the forearm is sufficient to accommodate a wide range of tension settings.

Figure 14:
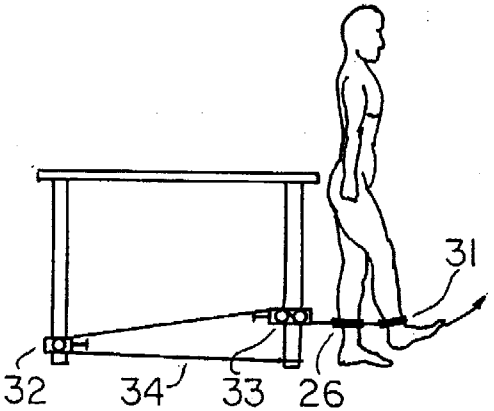
FIG. 14 provides a representation of the portable exercise device for hip and thigh exercise regimens.

The seated patient, then performs the requisite wrist or elbow movement exercises working against a set (and indexed) level of tension. Releasing the pull tension on the cord will engage the locking mechanism, but will not effect the the therapy goals since the patient's force is being applied against the scale.

c. Hip Flex: Refer to FIG. 14.

The fixed bayonet clip end of cord 34 is looped around the leg of an exercise platform (table, desk, work bench, etc.) nearest (adjacent) to the standing patient and the clip is secured to the cord to function as an anchor.

The pilot (single roller) pulley assembly 32 is secured to the far (opposite) leg of the exercise platform.

The dual roller pulley assembly 33 is secured to the leg of the exercise platform, adjacent to the patient and with the locking mechanism facing towards the patient.

The pulley cord 34 is threaded through the pulley assemblies with the precision straight scale secured to the bayonet clip at the slip knot end of the cord and the harness 31 is secured to the scale 26 in the same manner as described above for the knee flex profile.

The harness is looped around the ankle.

The patient maintaining a locked knee:

Facing the exercise platform moves the leg backwards against the scale tension to perform hyperextension and extension exercise routines.

Facing away from the platform moves the leg to perform extension routines.

Figure 15:
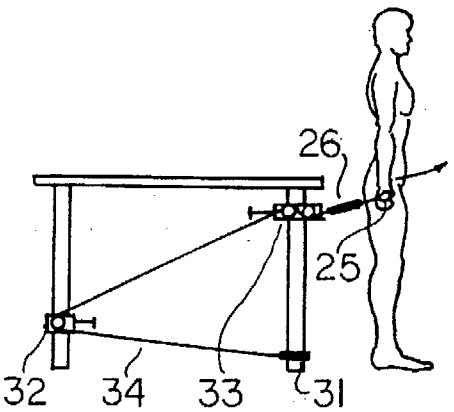
FIG. 15 provides a representation of the portable exercise device for shoulder exercise regimens.

Facing sideways to the platform rotates the leg outward to perform abduction and adduction routines.

d. Shoulder Flex: Refer to FIG. 15.

The pulley assembly 32 and 33 setup is as defined in c above, the harness is the anchor in lieu of the cord loop.

The precision straight scale 26 is secured to the bayonet clip at the slip knot end of cord 34 and the hand grip 25 is secured to the scale.

The patient maintaining a locked elbow:

Facing away from the exercise platform moves the arm forward and upward to perform flexion routines from the vertical to the horizontal arm position.

Facing towards the platform, and with the arm in the extended horizontal position, moves the arm forward and upward to perform the extension routine from the horizontal to the upright vertical arm position.

Facing the exercise platform, with the arm extended at shoulder height (and the cord taut) moves the arm downward toward the vertical position to perform the extension routine and continuing the movement beyond the vertical to perform the hyperextension routines.

Facing sideways (the cord passing in front of the body) and moving the arm outwards and return to the vertical position to perform the abduction and adduction routines.

We claim:

1. A portable therapeutic exercise device, comprising:

first pulley assembly means, comprising:

a single roller with a grooved periphery, two plates spaced apart to receive said single roller therebetween, a spacer located to maintain said two plates in a predetermined position at least sufficient to permit said single roller to be supported rotatably;

second pulley assembly means, comprising:

two rollers each with a grooved periphery, two plates spaced apart to receive said two rollers in a rotatable condition therebetween;

flexible cord assembly means, comprising:

a flexible cord or cable of a predetermined length and having two ends, clip means attached at each of said two ends for connecting each of said two ends to preselected hand grips, harnesses and anchors, and means on said flexible cord near one end of said two ends to adjust the length of said flexible cord;

means located along the length of said flexible cord to permit said flexible cord to move readily in one direction, while limiting movement in the opposite direction;

means for detachably affixing each of said first and said second pulley assembly means in a predetermined location during use; and said means for detachably affixing said first and said second pulley assembly means includes two 'O' clamp assembly means, each having at least one straight side to which said pulley assembly means can be attached, and threaded means with a handle on one end and a pressure plate on the opposite end for threading against an object for affixing said pulley assembly means.

2. A portable, exercise device as defined by claim 1, including scale means attached to said flexible cord in a predetermined location along its length for providing an indication of applied force.

3. A portable, exercise device as defined by claim 3, wherein said scale means is a precision straight scale to measure and provide an indication of applied force.

4. A portable, exercise device as defined by claim 3, wherein said scale means is a precision straight scale with springs to provide an indication of applied force.

5. A portable therapeutic exercise device as define by claim 1, comprising:

each of said two 'O' clamp assemblies having a pinioned hatch, a clamp screw assembly with two clamp screw holes, and two threaded holes and one unthreaded port to accommodate said first and second pulley assembly means;

a said first pulley assembly means having a second spacer, a roller axle, and two carriage bolts to mount and secure said pulley assembly means to said 'O' clamp assembly means;

a dual roller pulley assembly including a locking mechanism, two side plates and two carriage bolts to mount said first pulley assembly means to said 'O' clamp assembly means;

a flexible cord assembly including a cord with a crimped end loop securing a fixed bayonet clip to one end of said cord, and a slip knot connection to secure a bayonet clip on the opposite end of said cord;

a hand grip attached directly to said bayonet clip on said slip knot end of said flexible cord or to a straight scale attached to said bayonet clip to permit applying tension through said pulley assembly means;

a precision straight scale to measure tension applied through said pulley assembly means; and a dual purpose knee flex harness and anchor device including a web belt looped at both ends to accommodate a delta ring at one end for connection to the fixed bayonet clip, and a dowel to fit through said delta ring to form a harness or to secure the harness linearly.

6. A portable exercise device as defined in claim 1 including an 'O' clamp pinioned hatch secured by one fixed pin and one removable pin to allow opening the clamp to fit on a leg of an exercise platform and then closing and securing said pinioned hatch to apply clamping pressure with a clamp screw.

7. A portable exercise device as defined in claim 1 wherein a clamp screw assembly comprises a threaded terminal, a recessed pressure plate and a hex nut to secure said pressure plate detachably to said clamp screw assembly.

8. A portable exercise device as defined in claim 7 including two threaded clamp screw holes to provide alternatives for positioning the clamp screw assembly to accommodate varied profile posts.

9. A portable exercise device as defined in claim 1 including a pulley assembly locking mechanism comprising:

a locking trigger, locking anvil and a locking trigger backstop, wherein said pulley assembly means may be mounted to said 'O' clamp assembly means;

said locking mechanism is positioned towards a fixed end of the clamp assembly means to restrict said flexible cord from back sliding through said pulley assembly means when back pressures are applied, and said locking mechanism is positioned towards a hatch end of said 'O' clamp to restrict said flexible cord from feeding through said pulley assembly means when maximum resistive tension is applied.

* * * * *